US006450629B2

(12) United States Patent
Childers

(10) Patent No.: US 6,450,629 B2
(45) Date of Patent: Sep. 17, 2002

(54) METHOD AND APPARATUS FOR REFILLING INK CONTAINERS IN A MANNER THAT PRESERVES PRINTHEAD LIFE

(75) Inventor: Winthrop D. Childers, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/841,526

(22) Filed: Apr. 24, 2001

Related U.S. Application Data

(63) Continuation of application No. 09/293,733, filed on Apr. 16, 1999, now Pat. No. 6,283,586, which is a continuation-in-part of application No. 09/034,719, filed on Mar. 4, 1998, now Pat. No. 6,170,937.

(51) Int. Cl.[7] ..... B41J 2/175
(52) U.S. Cl. ..... 347/85
(58) Field of Search ..... 347/85, 86, 87; 141/2, 18

(56) References Cited

U.S. PATENT DOCUMENTS

| | | | | |
|---|---|---|---|---|
| 5,068,806 A | | 11/1991 | Gatten | 395/113 |
| 5,400,573 A | * | 3/1995 | Crystal et al. | 53/468 |
| 5,414,452 A | | 5/1995 | Accatini et al. | 347/7 |
| 5,506,611 A | | 4/1996 | Ujita et al. | 347/86 |
| 5,607,003 A | | 3/1997 | Gray | 141/285 |
| 5,694,156 A | | 12/1997 | Hoisington et al. | 347/7 |
| 5,699,091 A | | 12/1997 | Bullock et al. | 347/19 |
| 5,721,576 A | * | 2/1998 | Barinaga | 347/85 |
| 5,732,751 A | | 3/1998 | Schmidt et al. | 141/48 |
| 5,812,156 A | | 9/1998 | Bullock et al. | 347/19 |
| 5,844,579 A | | 12/1998 | Barinaga et al. | 347/7 |
| 5,845,682 A | | 12/1998 | Hayao | 141/18 |
| 5,886,719 A | * | 3/1999 | Zepeda | 347/85 |
| 5,969,734 A | | 10/1999 | Tamano | 347/85 |
| 6,170,937 B1 | * | 1/2001 | Childers et al. | 347/85 |
| 6,257,713 B1 | * | 7/2001 | Ahn | 347/86 |
| 6,283,586 B1 | * | 9/2001 | Childers | 347/85 |

FOREIGN PATENT DOCUMENTS

| | | | |
|---|---|---|---|
| EP | 0720916 A | 7/1996 | B41J/2/175 |
| EP | 0741038 A | 11/1996 | B41J/2/175 |
| EP | 0808718 A | 11/1997 | B41J/2/175 |
| GB | 2321623 A | 8/1998 | B41J/2/175 |
| WO | WO 85/00454 | 1/1985 | G07C/3/00 |
| WO | WO 94/11194 | 5/1994 | B41J/2/175 |

* cited by examiner

*Primary Examiner*—Michael Nghiem
(74) *Attorney, Agent, or Firm*—Kevin B. Sullivan

(57) ABSTRACT

The present disclosure relates to a method for refilling an ink container for an ink jet printing system. The ink container includes a ink reservoir having a negative gauge pressure therein. The method includes preventing air from entering the ink reservoir. The method also includes filling the ink reservoir with refill ink while preventing air from entering the ink reservoir.

8 Claims, 7 Drawing Sheets

METHOD AND APPARATUS FOR REFILLING INK CONTAINERS IN A MANNER THAT PRESERVES PRINTHEAD LIFE

CROSS REFERENCE TO RELATED APPLICATIONS

This is a continuation of application Ser. No. 09/293,733 now U.S. Pat. No. 6,283,586 filed on Apr. 16, 1999.

The present application is a continuation-in-part of patent application entitled, "Ink Container Refurbishment Method," Ser. No. 09/034,719 filed on Mar. 4, 1998, to Childers, et al., now U.S. Pat. No. 6,170,937 and assigned to the assignee of the present invention.

BACKGROUND OF THE INVENTION

This invention relates to inkjet printers and, more particularly, to an inkjet printing system that makes use of a semipermanent printhead that does not require an air purge mechanism.

Inkjet printing systems frequently make use of an inkjet printhead mounted to a carriage which is moved back and forth across a print media, such as paper. As the printhead is moved across the print media, control electronics activate an ejector portion of the printhead to eject, or jet, ink droplets from ejector nozzles and onto the print media to form images and characters. An ink supply provides ink replenishment for the printhead ejector portion.

Some printing systems make use of an ink supply that is replaceable separately from the printhead. When the ink supply is exhausted the ink supply is removed and replaced with a new ink supply. The printhead is then replaced at or near the end of printhead life and not when the ink supply is exhausted. When a replaceable printhead is capable of utilizing a plurality of ink supplies, we will refer to this as a "semipermanent" printhead. This is in contrast to a disposable printhead, that is replaced with each container of ink.

A significant issue with semipermanent printheads is premature failure due to loss of proper pressure regulation. To understand this failure, we need to consider printhead operation. To operate properly, many printheads have an operating pressure range that must be maintained in a narrow range of slightly negative gauge pressure, typically between −1 and −6 inches of water. Gauge pressure refers to a measured pressure relative to atmospheric pressure. Pressures referred to herein will all be gauge pressures. If the pressure becomes positive, printing and printing system storage will be adversely affected. During a printing operation, positive pressure can cause drooling and halt ejection of droplets. During storage, positive pressure can cause the printhead to drool. Ink that drools during storage can accumulate and coagulate on printheads and printer parts. This coagulated ink can permanently impair droplet ejection of the printhead and result in a need for costly printer repair. To avoid positive pressure, the printhead makes use of an internal mechanism to maintain negative pressure.

Air present in a printhead can interfere with the maintenance of negative pressure. When a printhead is initially filled with ink, air bubbles are often left behind. In addition, air accumulates during printhead life from a number of sources, including diffusion from outside atmosphere into the printhead and dissolved air coming out of the ink referred to as outgassing. During environmental changes, such as temperature increases or pressure drops, the air inside the printhead will expand in proportion to the total amount of air contained. This expansion is in opposition to the internal mechanism that maintains negative pressure. The internal mechanism within the printhead can compensate for these environmental changes over a limited range of environmental excursions. Outside of this range, the pressure in the printhead will become positive.

One solution to the air accumulation problem is discussed in patent application entitled "Printing System with Air Accumulation Control Means Enabling a Semipermanent Printhead Without Air Purge", Ser. No. 09/037,550 now U.S. Pat. No. 6,203,146 to Donald E. Wenzel, Mark Hauck, and Paul D. Gast filed Mar. 9, 1998, and assigned to the assignee of the present invention, incorporated herein by reference. Patent application Ser. No. 09/037,550 now U.S. Pat. No. 6,203,146 discloses a printing system having an air budget for the various components of the ink delivery system. These components include a printhead, an ink container, fluid conduit and fluid connections between the printhead and ink container. The air budget concept allocates an amount of air that can be introduced by each of these components over the printhead life to ensure the printhead functions properly. If more air is introduced than budgeted such that the total air accumulated in the printhead is more than the accumulator can compensate then a reduction in print quality can occur.

SUMMARY OF THE INVENTION

The present invention is a method and apparatus for refilling an ink container for an ink jet printing system. The ink container includes an ink reservoir having a negative gauge pressure therein. The method includes preventing air from entering the ink reservoir. The method also includes filling the ink reservoir with refill ink while preventing air from entering the ink reservoir.

One aspect of the method of the present invention is the ink container includes a diaphragm that defines, at least partially, a variable volume chamber. The variable volume chamber is fluidically coupled to the ink reservoir and configured such that expansion of the variable volume chamber draws ink from the ink reservoir into the variable volume chamber. Wherein the step of the preventing air from entering the ink reservoir includes compressing the variable volume chamber to reduce the negative gauge pressure within the ink reservoir to prevent air from entering a fill port within the ink reservoir.

Another aspect of the method of the present invention includes positioning a sealing member to prevent air from entering a fill port associated with the ink container. Wherein the step of filling the ink reservoir with refill ink is accomplished by passing ink through the sealing member and into the ink reservoir.

DETAILED DESCRIPTION OF THE PREFERRED EMBODIMENT

The present invention is a technique for filling ink containers to preserve the life of a printhead within the printing system. An important characteristic of the printing system is that the printing system has a limited tolerance for accommodating air within an ink delivery system that provides ink to a printhead. Once an excessive amount of air enters an ink delivery system, the system is unable to properly compensate for environmental changes such as temperature increases or pressure drops resulting in reduced print quality. Before discussing the technique for filling ink containers of the present invention, it will be helpful to first discuss the printing system which makes use of these ink containers. The technique of the present invention will then be discussed emphasizing the benefits of the use of this technique to extend printhead life.

Figure 1:
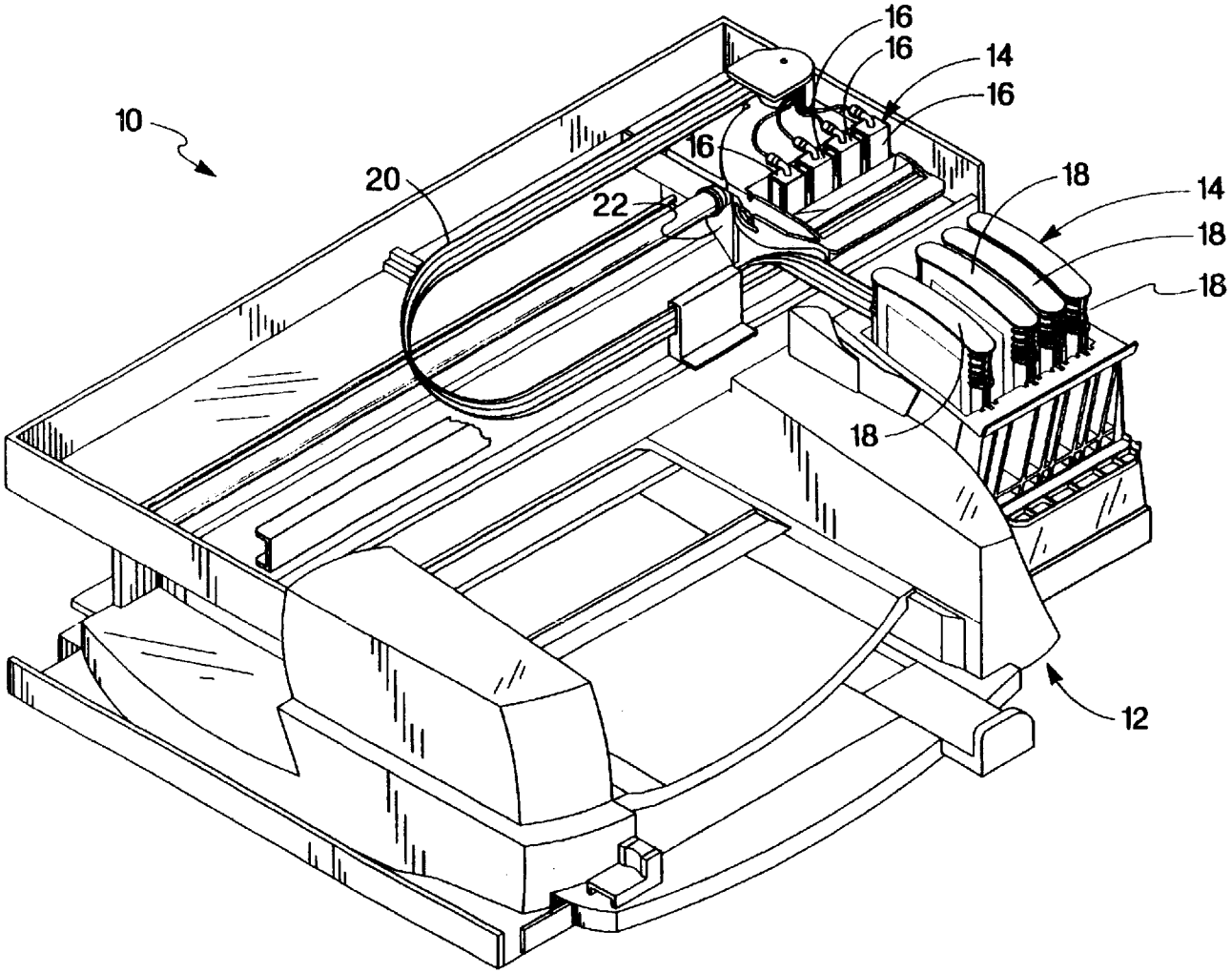
FIG. 1 depicts a representation of a printing system which makes use of ink containers for which the technique of the present invention is used for refilling.

FIG. 1 depicts an exemplary embodiment of an inkjet printing system 10, shown with its cover removed. The inkjet printing system 10 includes a printer portion 12 having a plurality of replaceable printing components 14 installed therein. The plurality of replaceable printing components 14 includes a plurality of printheads for selectively depositing ink in response to control signals and a plurality of ink containers 18 for providing ink to each of the plurality of printheads 16. Each of the plurality of printheads 16 is fluidically connected to each of the plurality of ink containers by a plurality of flexible conduits 20.

Each of the plurality of printheads 16 is mounted in a scanning carriage 22, which is scanned past a print media (not shown). As the plurality of printheads 16 are moved relative to the print media, ink is selectively ejected from a plurality of orifices in each of the plurality of printheads 16 to form images and text.

Figure 2:
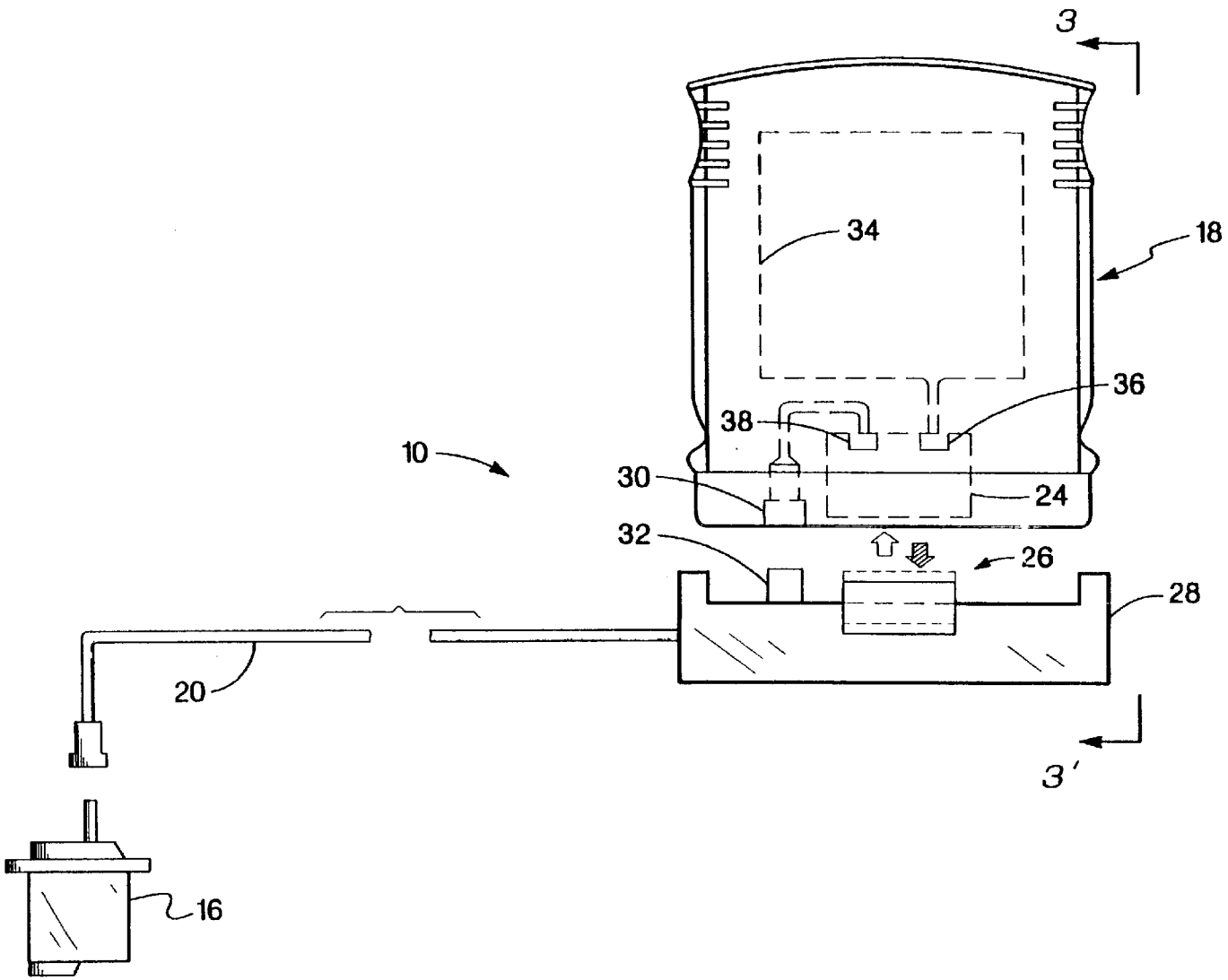
FIG. 2 depicts a simplified schematic representation of the printing system of FIG. 1.

FIG. 2 depicts a simplified schematic representation of the inkjet printing system 10 of FIG. 1. The inkjet printing system 10 includes ink container 18 that includes a diaphragm pump 24 for providing a pressurized source of ink to the printhead 16. An actuator 26 that is associated with a docking station or supply station 28 actuates the diaphragm pump 24.

With the ink container 18 properly installed into the supply station 28 a fluid outlet 30 associated with the ink container 18 fluidically couples with a fluid inlet 32 associated with the supply station 28. The fluid inlet 32 is fluidically coupled to the printhead by the conduit 20.

The diaphragm pump 24 is coupled to an ink reservoir 34 within the ink container by a fluid inlet 36 that selectively allows ink to flow into the diaphragm pump 24. A fluid outlet 38 allows ink to exit the diaphragm pump 24. An ink conduit connects the fluid outlet 38 with the fluid outlet 30 associated with the ink container 18. As the actuator 26 engages the diaphragm pump 24, pressurized ink within the diaphragm pump is forced out of fluid outlet 38 to provide a source of pressurized fluid at fluid outlet 30 of the ink container 18. In this manner, the diaphragm pump 24 and actuator 26 ensure a constant supply of pressurized ink to the printhead 16.

One aspect of the method of the present invention is the ink container includes a diaphragm that defines, at least partially, a variable volume chamber. The variable volume chamber is fluidically coupled to the ink reservoir and configured such that expansion of the variable volume chamber draws ink from the ink reservoir into the variable volume chamber. Wherein the step of the preventing air from entering the ink reservoir includes compressing the variable volume chamber to reduce the negative gauge pressure within the ink reservoir to prevent air from entering a fill port within the ink reservoir.

During printing, pressurized ink flows from the ink container 18 to the printhead 16 whereupon ink is selectively ejected onto print media. The printhead 16 includes an accumulator mechanism that allows the printhead 16 to accommodate any air introduced into the printing system 10. Air which accumulates in the printhead 16 tends to expand under various environmental and temperature conditions during both printing and nonprinting conditions. The accumulator (not shown) compensates for the expansion and contraction of air to maintain a constant negative pressure within the printhead 16. This negative pressure is necessary to ensure proper printhead operation as well as to prevent leakage of ink from the printhead nozzles sometimes referred to as drooling. Because of various printhead size and printhead cost constraints the accumulator has a limited capacity to compensate for accumulated air for a given environmental operating range. The warehouse capacity as well as operation of the accumulator is discussed in more detail in patent application entitled, "Printing System with Air Accumulation control Means Enabling a Semipermanent Printhead Without air Purge," Ser. No. 09/037,550 now U.S. Pat. No. 6,203,146 to Donald E. Wenzel, Mark Hauck, and Paul D. Gast filed Mar. 9, 1998, and assigned to the assignee of the present invention, incorporated herein by reference.

It is critical that the ink container 18 not introduce more air into the printhead than the volume of air which the printhead 16 is capable of warehousing as discussed in patent application Ser. No. 09/037,550 now U.S. Pat. No. 6,203,146. The ink container 18 is initially manufactured to contain less than a certain threshold of air. By limiting the amount of air introduced by the ink container 18 allows for the ink containers 18 to be replaced numerous times without introducing more air into the printhead 16 than the accumulator is capable of compensating for.

The present invention is directed to a technique for refilling the ink container with a refill ink after the initial ink is depleted. The initial ink is filled in the ink container on manufacturing of the ink container 18. One technique for ensuring the ink container 18 is depleted of air when the initial ink is filled is discussed in U.S. Pat. No. 5,732,751 entitled, "Filling Ink Supply Containers," issued on Mar. 31, 1998, to Mark J. Green, Ronald W. Hall, and Glen E. Schmidt, which discusses a technique for flushing the ink container with $CO_2$ to displace air from the ink container. The $CO_2$ is then soluble with the ink to dissolve in the ink thereby preventing air to accumulate or warehouse within the printhead 16. The present technique, in contrast, provides for a technique which does not require expensive manufacturing processing and is therefore better suited for lower volume refilling of ink containers 18. The technique of the present invention allows refilling of the ink container 18 with a refill ink that is different from the initial ink.

Figure 3:
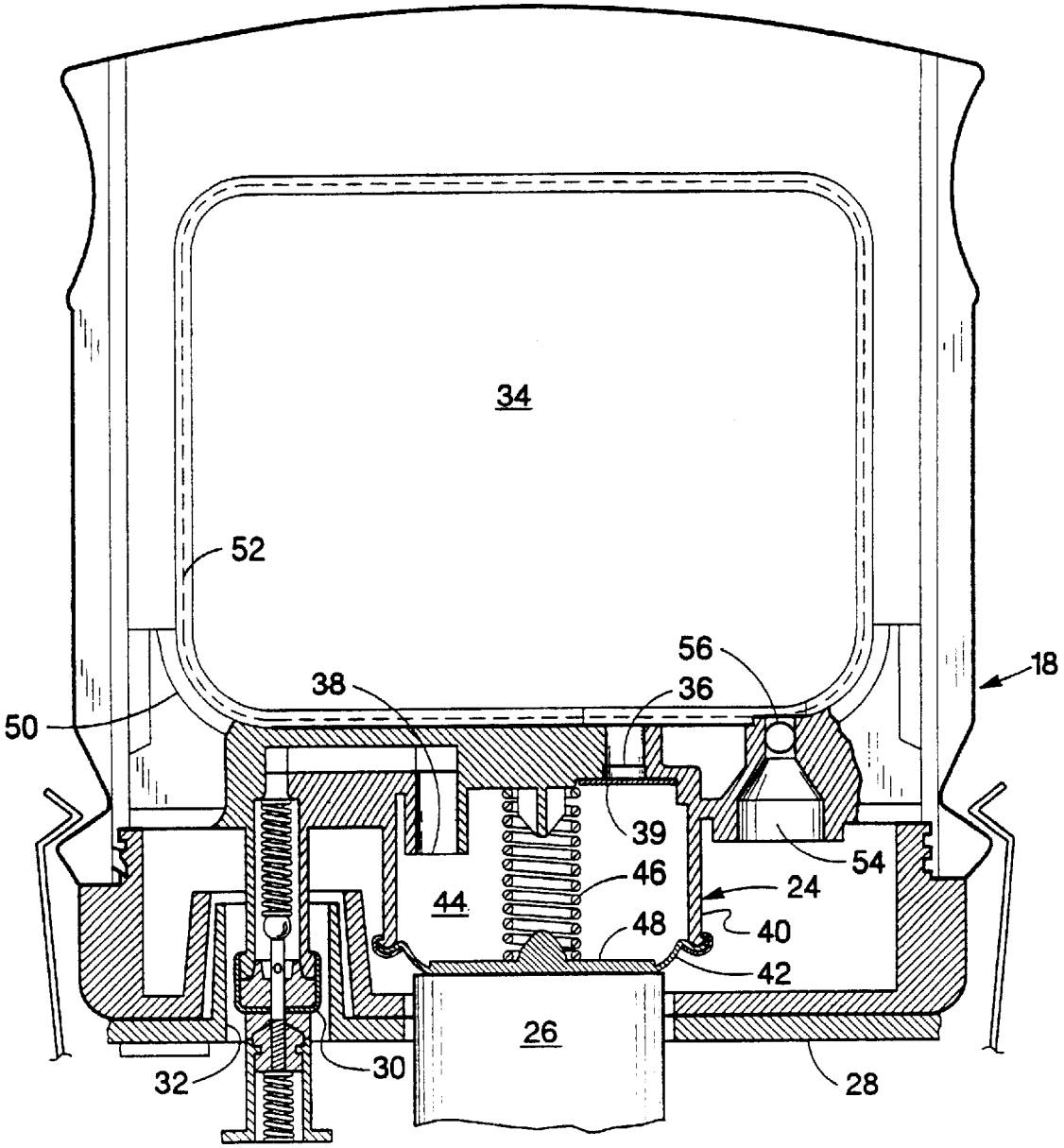
FIG. 3 depicts a cross section taken across lines 3–3' of the ink container of FIG. 2 shown with an actuator positioned for actuating a diaphragm pump.

FIG. 3 depicts a sectional view of the ink container 18 mounted to the supply station 28 shown in FIG. 2. The ink container 18 includes the ink reservoir 34 that is in fluid communication with the diaphragm pump 24 by the inlet 36.

Ink is selectively provided to the diaphragm pump 24 through the inlet 36. In one preferred embodiment, the inlet 36 includes a check valve 39 for allowing ink to pass from the ink reservoir 34 to the diaphragm pump 24 and for limiting ink passage from the diaphragm pump 24 to the ink reservoir 34.

In the preferred embodiment, the ink reservoir 34 is formed from a frame 50 having a face to which a plastic sheet 52 is attached to enclose the sides of the reservoir 34. This flexible sheet 52 is flexible to allow the volume of the reservoir 34 to vary as ink is depleted from the reservoir 34. This helps to allow withdrawal and use of all the ink within the reservoir by reducing the amount of backpressure created as ink is depleted from the reservoir. These sheets 52 are preferably heat staked to the frame 50. Further detail of the construction of the ink container 18 is disclosed in U.S. Pat. No. 5,844,579 to Baranga et al., filed Dec. 4, 1995, and assigned to the assignee of the present invention.

The diaphragm pump 24 in the preferred embodiment includes a chassis 40 and a diaphragm 42 that together define a variable volume chamber 44. Within the chamber 44 is a biasing means 46 for biasing the diaphragm 42 towards the actuator 26. In the preferred embodiment, the biasing means 46 is a spring that biases a pressure plate portion 48 of the diaphragm 42.

The actuator 26 engages the diaphragm 42 and displaces the diaphragm 42 towards the chamber 44 compressing the spring 46. As the diaphragm 42 is displaced toward the chamber 44 the volume of the chamber 44 is reduced. This reduction in volume of chamber 44 pressurizes ink within the chamber 44 causing ink to pass through the outlet 38 toward the printhead 16. As the actuator 26 is retracted away from the diaphragm 42, the spring 46 relaxes, displacing the diaphragm 42 away from the chamber 44, increasing a volume associated with the chamber 44 thereby reducing the chamber pressure. As a pressure associated with the chamber 44 is reduced, ink is allowed to flow from the ink reservoir 34 into the chamber 44 through check valve 39. In the preferred embodiment, the check valve 39 allows ink to flow only from the ink reservoir 34 to the chamber 44 and limits ink flow from the chamber 44 to the ink reservoir 34.

Figure 4A:
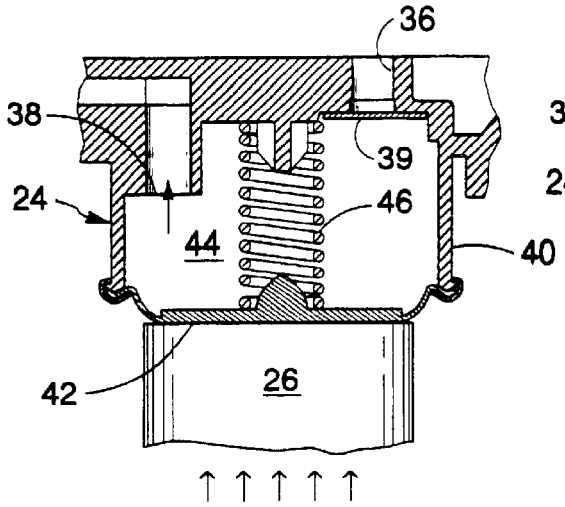
FIGS. 4A, 4B, 4C, 4D, and 4E depict a sequence of cross sectional views of the diaphragm pump of FIG. 3 shown greatly enlarged to illustrate operation of the diaphragm pump.
Figure 4D:
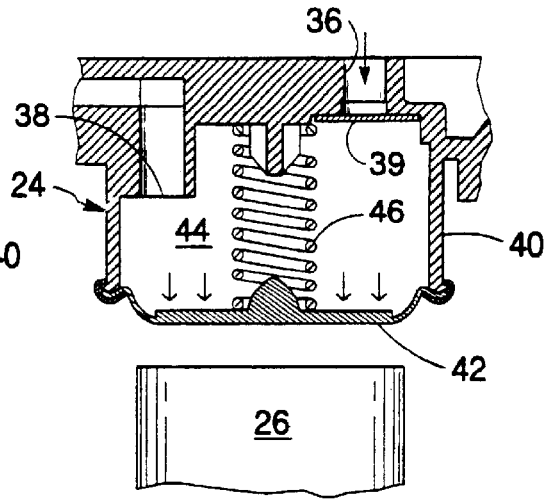
Figure 4B:
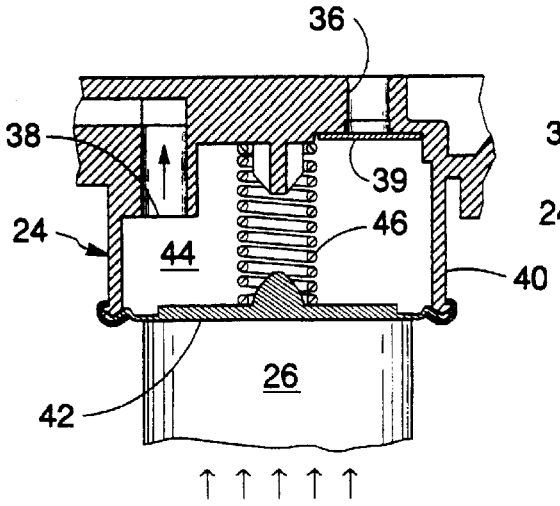
Figure 4E:
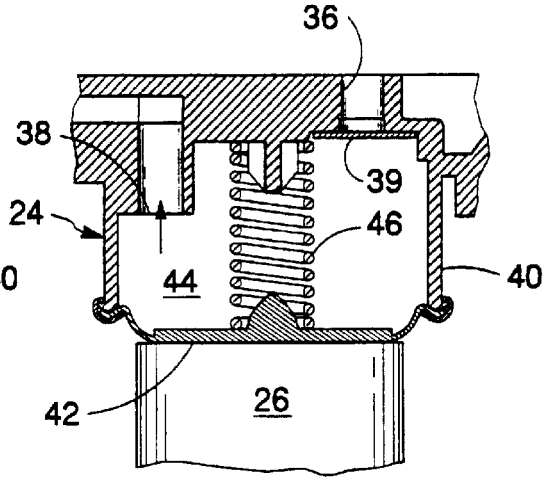
Figure 4C:
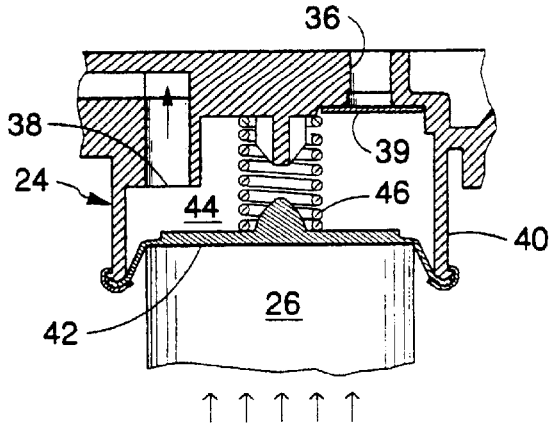

FIGS. 4A through 4E depict the operation of the diaphragm pump 24 for providing pressurized ink to the printhead 16. FIG. 4A depicts the beginning of the pump cycle wherein the inlet valve 39 is closed, preventing fluid flow between the ink reservoir 34 and the pump chamber 44 as the actuator 26 engages the diaphragm 42 and begins compressing the spring 46. FIGS. 4B and 4C depict the actuator 26, applying further pressure to the diaphragm 42 until the actuator 26 is fully extended as shown in FIG. 4C. The displacement of the diaphragm 42 reduces the volume of the chamber 44 thereby forcing ink out of the chamber 44 through outlet 38.

FIG. 4D depicts the removal or retraction of actuator 26 from the diaphragm 42 causing the spring 46 to expand. As the diaphragm 42 moves outward toward the actuator 26, the volume of the chamber 44 increases, drawing ink in from the ink reservoir 34 through the check valve 39 to replenish the chamber 44. As the chamber volume 44 expands, either a check valve 39 is placed at the fluid outlet 38 or the backpressure within the conduit 20 prevents ink from being drawn from the printhead into the chamber 44.

FIG. 4E depicts the beginning of the next pumping cycle initiated by the actuator 26 engaging and urging the diaphragm 42 inward toward the chamber 44. As the diaphragm is urged inward the chamber 44 volume is reduced, closing the check valve 39 and forcing ink from the chamber 44 through fluid outlet 38. The pumping cycle shown in FIGS. 4A through 4D is repeated until both the ink reservoir 34 and the chamber 44 is depleted of ink. This out-of-ink condition is determined by sensing a change in the resistance provided by the diaphragm 42 to the actuator 26 as the actuator repeats pumping cycles shown in FIGS. 4A through 4D. Once ink has depleted from the ink reservoir 34 and the chamber 44 the actuator 26 encounters little resistance to pump actuation cycles by the actuator 26 and an out-of-ink condition is detected.

There are several problems related to refilling the ink container 18. One problem is that once an out-of-ink condition is detected by the printing system, the ink reservoir 34 is completely depleted of ink. Once all the ink is drawn from the ink reservoir 34, the sidewalls 52 tend to be drawn inward toward each other. The elasticity of the sidewalls 52 can create a negative pressure within the ink reservoir 34. Opening of a fill port 54 by removing a sealing ball 56 can result in drawing of air into the ink reservoir 34 to equalize this negative pressure. Once air enters the ink reservoir 34, this air tends to accumulate in the printhead 16. If the volume of this accumulated air in the printhead 16 becomes sufficiently large or after several refills this air becomes sufficiently large to prevent the accumulator from properly regulating the back pressure of the printhead, then the printhead will fail before end-of-life.

The technique of the present invention is a method for preventing air from entering the reservoir 34 or the ink chamber 44 when refilling the ink container 18 with a refill ink. The ink container 18 is typically refilled after the printing system has identified an out-of-ink condition and therefore a negative gauge pressure exists within the ink container 18.

Figure 5:
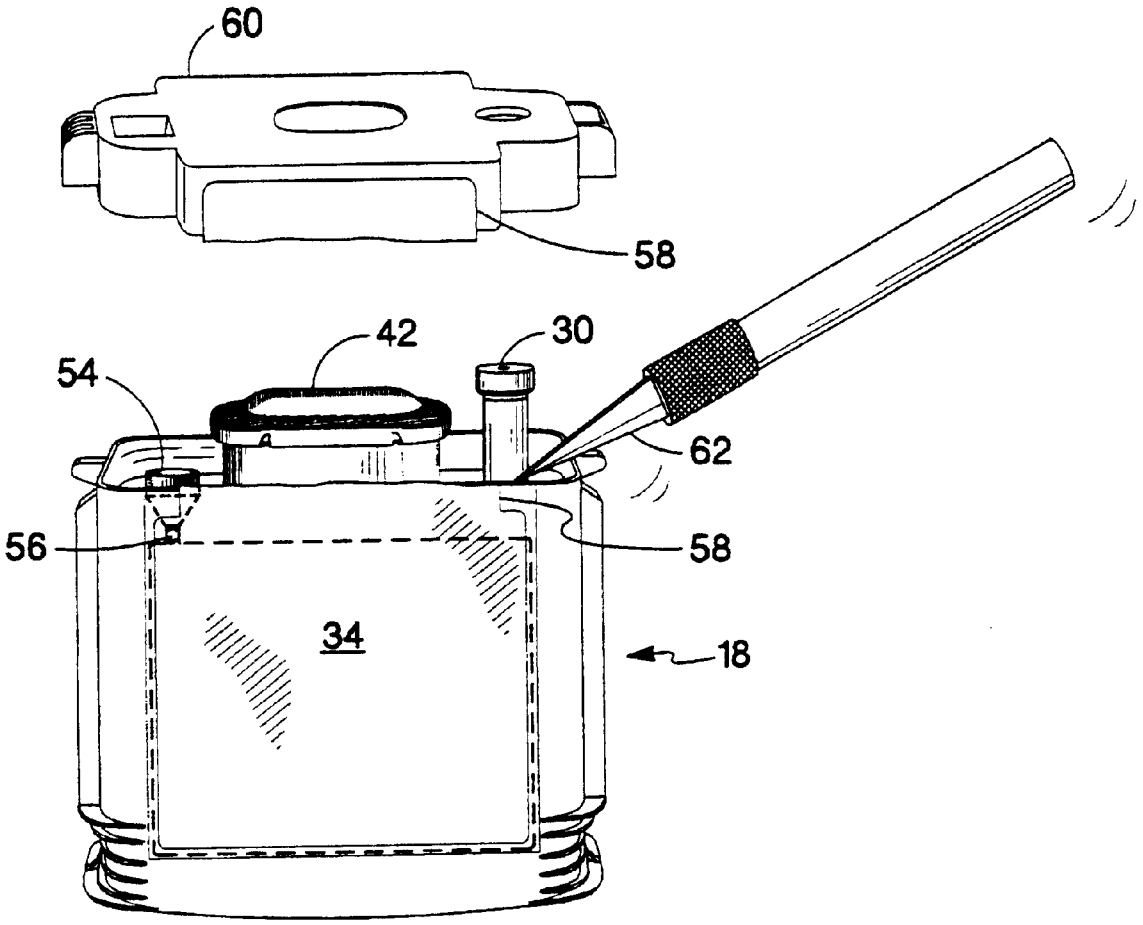
FIG. 5 depicts a method of the present invention for removing an end cap portion of the ink container.

FIG. 5 depicts the technique of the present invention for filling the ink container 18 with a refill ink after the printing system 10 has indicated that the initial ink is exhausted. The technique begins by severing a label 58 and displacing or removing an end cap 60 to expose the fill port 54. The label 58 is preferably severed using a sharp object such as a knife blade 62. Alternatively, the label 58 can be removed to allow the removal of the end cap 60.

FIGS. 6A, 6B, 6C, 6D, and 6E depict one aspect of the technique of the present invention for refilling the ink container 18 after the initial ink in the ink container is exhausted. As discussed previously, when the printing system 10 indicates that the ink container 18 is exhausted the variable volume chamber 44 of pump 24 is depleted of ink. After the printing system actuates the pump 24 with actuator 26 to force ink out of the chamber 44, a negative gauge pressure results in the chamber 44. This negative gauge pressure results because there is no more ink remaining in ink reservoir 34 to equalize this pressure. In addition, the negative backpressure at the fluid inlet 32 of the supply station 28 prevents the chamber 44 from drawing ink back into the chamber from fluid inlet 32.

Figure 6A:
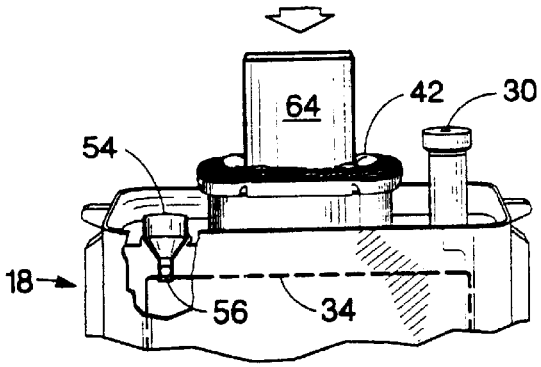
FIGS. 6A, 6B, 6C, 6D, and 6E depict a technique of the present invention for refilling the ink container in a manner that preserves printhead life.

The technique of the present invention prevents or limits the ingestion of air into the ink reservoir 34 and the pump chamber 44 during the refilling of the ink container 18 with a refill ink. As discussed previously, it is critical that air ingestion into the ink container 18 be minimized during the refill process to prevent a reduction of printhead life. The technique begins by first removing the protective cap 60 to expose the fill port 54 as discussed with respect to FIG. 5. As shown in FIG. 6A, a compression member 64 is biased against the diaphragm 42 to urge the diaphragm 42 toward the ink container 18 and reduce the volume of the variable volume chamber 44. The forcing member 64 is sized to properly fit within the pump chamber 24. Biasing the diaphragm 42 inward to reduce the volume of the variable volume chamber 44 tends to reduce the negative gauge pressure within the chamber 44 as well as within the ink reservoir 34.

Figure 6D:
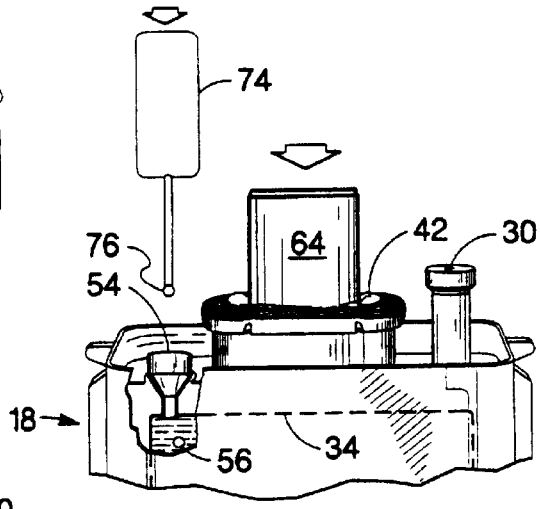
Figure 6B:
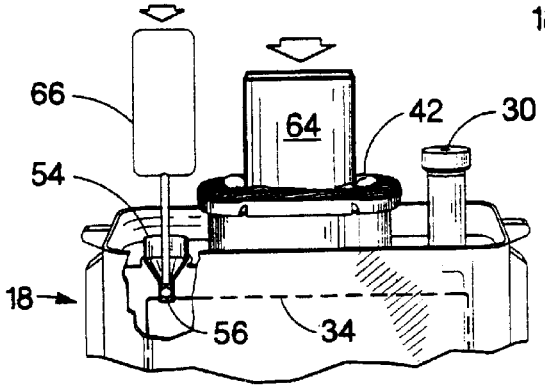

As shown in FIG. 6B, while the forcing member 64 continues to bias the diaphragm 42 inward, an extraction tool 66 is used to unseat the sealing ball 56 from the fill port 54. The extraction tool 66 can be used to either punch the sealing ball 56 into the ink reservoir 34 as depicted by FIGS. 6C and 6D or, alternatively, withdraw the sealing ball 56 from the ink container 18.

One such method for withdrawing the sealing ball 56 is to use an extraction tool 66 that makes use of a threaded tap at the tip. The threaded tap is used to tap into the sealing ball 56 and then extract the sealing ball from the ink container 18. Once the sealing ball 56 is unseated, the ink reservoir 34 and the variable volume chamber 44 tend not to draw air into the ink container 18 because of the reduced or eliminated gauge pressure resulting from compression of the diaphragm 42 with the forcing member 64.

Figure 6E:
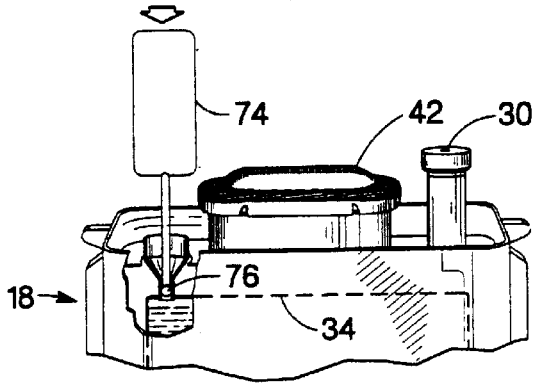
Figure 6C:
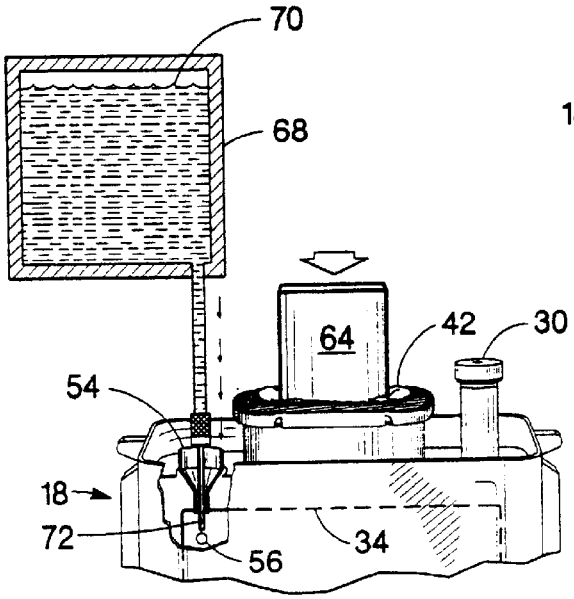

As shown in FIG. 6C, an ink reservoir 68 filled with a refill ink 70 is used to provide ink through a fill nozzle 72 which is inserted into the fill port 54 to replenish the ink reservoir 34. Once the ink reservoir 34 is filled with a refill ink 70, an insertion tool 74 is used to insert a replacement sealing member 76 such as a sealing ball into the fill port 54 to seal the fill port as shown in FIG. 6D. The forcing member 64 continues to bias the diaphragm 42 inwardly to reduce the chamber volume 44 until the fill port 54 is sealed. Once the fill port 54 is sealed the forcing member 64 is removed as shown in FIG. 6E. The insertion tool 74 can then be removed and the cap 60 replaced on the ink container 18 to complete the refill process.

Figure 7B:
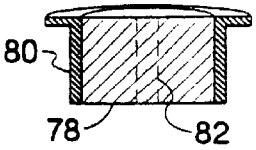
FIGS. 7A, 7B, 7C, 7D, 7E and 7F depict an alternative technique and apparatus of the present invention for refilling the ink container in a manner that preserves printhead life.
Figure 7A:
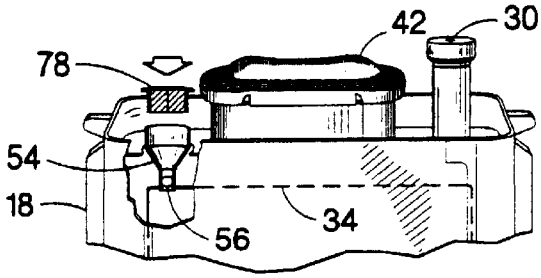

FIGS. 7A, 7B, 7C, 7D, and 7E depict another aspect of the present invention for refilling the ink container 18 with a refill ink to prevent air ingestion into the ink container thereby preserving the lifetime of the printhead 16. The technique begins by the removal of the end cap 60 to expose the fill port 54 as discussed with respect to FIG. 5. As shown in FIG. 7A, a sealing member 78 is inserted into the fill port 54 to seal the fill port 54. The sealing member 78 includes an outer sealing surface 80 and an inner sealing surface 82. In the preferred embodiment the sealing member 78 is formed of a compliant material and sized to be inserted into the fill port 54 to form a seal between the outer sealing surface 80 and an inner surface of the fill port 54. The sealing member 78 is shown greatly enlarged in FIG. 7B. The inner sealing surface 82 is a preformed slot in the sealing member 78. The compliance of the sealing member 78 causes the slot 82 to come together, thereby forming a seal for preventing air or fluid from passing the fill port 54.

Figure 7C:
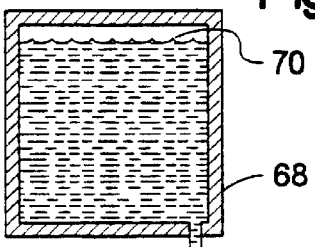
Figure 7C:
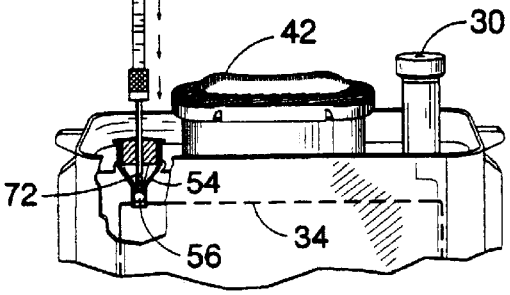
Figure 7D:
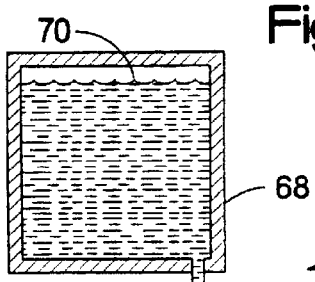
Figure 7D:
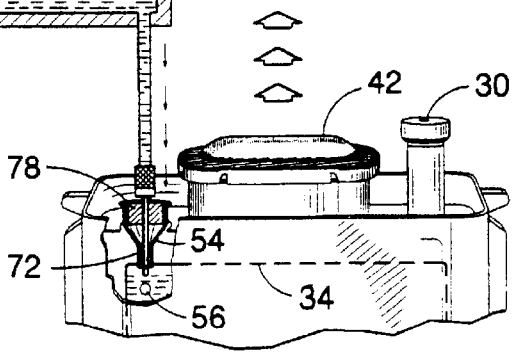
Figure 7E:
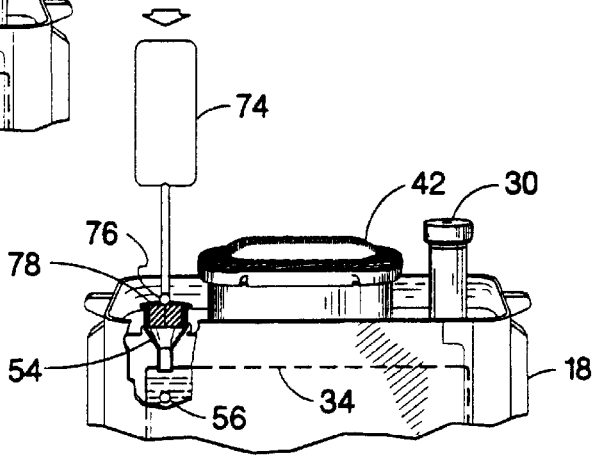

As shown in FIG. 7C, a fill port 72 is inserted through the slot 82 in the sealing member 78. The fill port 72 is used to dislodge the sealing ball 56 as shown in FIG. 7D and ink is introduced into the ink reservoir 34. Alternatively, an extraction tool 66 as shown in FIG. 6B is used to insert through slot 82 to dislodge the sealing ball 56 from the fill port 54. The slot 82 is sufficiently compliant to allow the insertion of the fill port 72 therethrough while forming a seal between the sealing member 78 and the fill port 72. As the refill ink 70 fills the ink reservoir 34 and ink chamber 44, the negative gauge pressure within the ink container 18 is reduced and the diaphragm 42 expands slightly as shown in FIG. 7D. It should be noted that the diaphragm 42 expands not from the entry of air into the ink container 18 but from-the entry of refill ink 70 into the ink container 18.

Figure 7F:
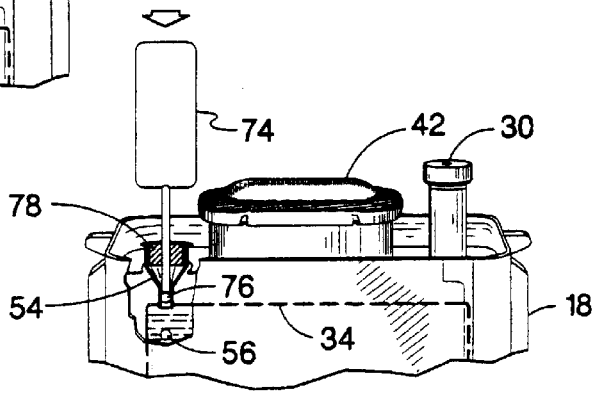

An insertion tool 74 is then used to insert a sealing member 76 such as a sealing ball through the sealing surface 82 of the sealing member 78 and seated to seal the fill port 54 as shown in FIG. 7F. The insertion tool 74 is then removed from the sealing member 78. The sealing member 78 can be removed from the fill port 54 or left in place to seal the fill port 54 thereby eliminating the need for sealing member 76. The cap 60 is then positioned on the ink container 18, and the refill process is complete.

The technique of the present invention allows the filling of the ink container 18 in a manner which prevents or limits air ingestion into the ink container 18. This technique ensures that the fill port 54 is not exposed to atmospheric pressure while a negative gauge pressure is within the ink container 18. By preventing air from entering the ink container 18 to equalize this negative gauge pressure within the ink container the technique of the present invention eliminates or reduces air within the ink container after the refilled process is complete. Reducing the air within the ink container 18 tends to reduce air ingestion into the printhead 16 which has limited capacity to accommodate air. By limiting or reducing the air which enters the printhead 16, the technique of the present invention prevents the lifetime of the printhead 16 from being cut short due to excessive air ingestion.

What is claimed is:

1. A method for refilling a previously used ink container for an ink jet printing system wherein the ink container includes an ink reservoir exhibiting an at least partially depleted ink condition, the ink reservoir including a fill port that is sealed, the method comprising:

inserting a separate sealing member in the fill port that is sealed to prevent passage of air into the ink reservoir through the fill port that is sealed;

unsealing the fill port that is sealed while the sealing member prevents passage of air into the ink reservoir through the fill port; and filling the ink reservoir, through the sealing member and the fill port that is unsealed, with a refill ink while the sealing member prevents passage of air into the ink reservoir through the fill port.

2. The method for refilling a previously used ink container of claim 1 wherein the filling the ink reservoir with a refill ink includes:

inserting a hollow needle portion through a septum portion of the sealing member and passing ink through the hollow needle portion into the ink container.

3. The method for refilling a previously used ink container of claim 1 wherein the sealing member includes an outer sealing surface for forming a seal with the fill port and an inner sealing surface for forming a fluid seal with a fluid conduct for delivering the refill ink.

4. The method for refilling a previously used ink container of claim 1, and further including:

resealing the fill port while the sealing member prevents passage of air into the ink reservoir through the fill port.

5. The method for refilling a previously used ink container of claim 4 wherein the step of resealing the fill port includes:

inserting a sealing ball through the sealing member into the fill port while the sealing member prevents air from entering the ink reservoir as the sealing ball is positioned to seal the fill port in the ink reservoir.

6. The method for refilling a previously used ink container of claim 4, and further including:

removing the sealing member.

7. The method for refilling a previously used ink container of claim 4 wherein the step of unsealing the fill port includes removing a first sealing ball from the fill port, and wherein the step of resealing the fill port includes inserting a second sealing ball through the sealing member into the fill port while the sealing member prevents air from entering the ink reservoir as the second sealing ball is positioned to seal the fill port in the ink reservoir.

8. The method for refilling a previously used ink container of claim 1 wherein the step of unsealing the fill port includes:

removing a sealing ball from the fill port.

* * * * *